US007426358B2

(12) United States Patent
Yoshida et al.

(10) Patent No.: US 7,426,358 B2
(45) Date of Patent: Sep. 16, 2008

(54) IMAGE FORMING APPARATUS AND METHOD HAVING A CLEANERLESS IMAGE FORMING UNIT

(75) Inventors: Minoru Yoshida, Machida (JP); Takeshi Watanabe, Yokohama (JP); Masashi Takahashi, Yokohama (JP); Toshihiro Kasai, Yokohama (JP); Shoko Shimmura, Yokohama (JP); Takashi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 289 days.

(21) Appl. No.: 11/081,962

(22) Filed: Mar. 17, 2005

(65) Prior Publication Data

US 2006/0210309 A1 Sep. 21, 2006

(51) Int. Cl.
*G03G 15/30* (2006.01)

(52) U.S. Cl. ..... 399/149; 399/222; 399/318

(58) Field of Classification Search ..... 399/149, 399/222, 313, 297, 299, 300, 302, 306, 308, 399/318

See application file for complete search history.

(56) References Cited

U.S. PATENT DOCUMENTS

| | | | | |
|---|---|---|---|---|
| 4,727,395 | A | 2/1988 | Oda et al. | |
| 5,051,332 | A | 9/1991 | Hosoya et al. | |
| 5,159,393 | A * | 10/1992 | Hiroshima et al. | 399/313 |
| 5,283,618 | A | 2/1994 | Hosoya et al. | |
| 6,132,916 | A * | 10/2000 | Ueda et al. | 430/108.4 |
| 6,785,486 | B2 | 8/2004 | Yoshida et al. | |
| 6,846,604 | B2 * | 1/2005 | Emoto et al. | 399/320 |
| 2004/0022556 | A1 * | 2/2004 | Nomura | 399/116 |
| 2004/0179082 | A1 | 9/2004 | Aoki et al. | |
| 2004/0179860 | A1 | 9/2004 | Watanabe et al. | |
| 2004/0179880 | A1 | 9/2004 | Takahashi et al. | |
| 2004/0228657 | A1 | 11/2004 | Takahashi et al. | |
| 2004/0265023 | A1 | 12/2004 | Yoshida et al. | |
| 2005/0031383 | A1 | 2/2005 | Watanabe et al. | |

FOREIGN PATENT DOCUMENTS

| | | | |
|---|---|---|---|
| JP | 5-188637 | A | 7/1993 |
| JP | 7-64366 | A | 3/1995 |
| JP | 9-146334 | A | 6/1997 |
| JP | 2953664 | B2 | 7/1999 |
| JP | 2000-298388 | A | 10/2000 |
| JP | 3342217 | B2 | 8/2002 |

* cited by examiner

*Primary Examiner*—David M. Gray
*Assistant Examiner*—Ryan D Walsh
(74) *Attorney, Agent, or Firm*—Foley & Lardner LLP

(57) ABSTRACT

There is provided an image forming apparatus comprising a developing device containing a toner having an average particle diameter of 2 to 5 μm and a spherical degree of 1 to 1.2, and a transfer member which is pressed against the image carrier by a pressing force having a total load of 150 g to 1500 g and a surface load of 10 to 150 g/cm$^2$ at the time of transfer.

16 Claims, 5 Drawing Sheets

IMAGE FORMING APPARATUS AND METHOD HAVING A CLEANERLESS IMAGE FORMING UNIT

BACKGROUND OF THE INVENTION

The present invention relates to an image forming apparatus which develops a static charge image and a magnetic latent image in electrophotography, electrostatic printing, magnetic recording and others, and more particularly to an image forming apparatus using a heat fusing scheme such as heat roller fusing.

A cleanerless process which does not have a cleaner such as a blade on a photoreceptor surface is a technique which is advantageous to a reduction in size of an apparatus or conservation of a toner, and various inventions of the cleanerless process have been disclosed. For example, U.S. Pat. No. 4,727,395 discloses a development/simultaneous cleaning technique in an reversing phenomenon. In particular, this technique is also effective in realization of full color in recent image forming apparatuses and has begun to be adopted in a four-drum tandem mode, and, e.g., Japanese Patent No. 3342217, Jpn. Pat. Appln. KOKAI Publication No. 7-64366 and others disclose examples concerning the cleanerless process having this tandem configuration.

As merits of the cleanerless process, there are simplification of a configuration since a photoreceptor cleaner is not necessary, realization of long duration of life of a photoreceptor because the photoreceptor is not scraped by a cleaner, an improvement in toner consumption efficiency since a post-transfer residual toner is recovered by a developing device for recycling, and others.

On the other hand, as demerits of the same, filming is apt to occur on a photoreceptor surface due to the toner since a blade is not provided on the photoreceptor. Occurrence of filming obstructs a demand for a reduction in fusing temperature in recent years. Further, since a post-transfer residual toner passes through a charged part and an exposed part, there is a problem that a memory is apt to be generated in an image due to an exposure in particular. When the memory is generated, an image quality is deteriorated. Furthermore, in case of a tandem type color image forming apparatus, reverse transfer from a color station on a preceding stage to a color station on a subsequent stage occurs and a mixed color is generated depending on an image to be printed, thereby resulting in a change in hue.

Therefore, prevention of occurrence of a memory and a mixed color has been extensively tried in a color image forming apparatus in particular by forming the toner into a spherical shape and increasing a transfer performance. On the other hand, one of factors of filming is a wax component contained in the toner.

As a method of realizing a spherical shape of the toner, there can be considered a method which forms a spherical shape while heating a polymerized toner manufactured by using a polymerization method or a toner created by a grinding method. In case of the toner manufactured by the polymerization method, there can be considered that a countermeasure against filming is taken by providing a polymeric resin layer on an outermost layer of the toner whilst transfer properties are improved. On the other hand, in case of the toner formed into a spherical shape while heating the toner created by the grinding method, the wax is apt to elute on the toner surface and a filming performance is deteriorated. When using such a toner, taking a countermeasure against filming and improving the transfer properties can be considered by setting a pressure of a transfer nip section where filming is generated, a nip width and others as predetermined conditions.

Prevention of filming of the toner by improving surface properties of a photoreceptor can be considered. Avoidance of filming of the toner on a photoreceptor by application of a mold releasing agent such as a metal soap on the photoreceptor has been also tried.

BRIEF SUMMARY OF THE INVENTION

In view of the above-described problems, it is an object of the present invention to provide an image forming apparatus which is intended to improve the transfer efficiency and reduce a toner quantity required to obtain a predetermined concentration by preventing the occurrence of filming of an image carrier and the occurrence of a memory, and can sufficiently cope with a cleanerless process, a reduction in size and conservation of the toner.

According to the present invention, there is provided an image forming apparatus having an image forming unit which comprises charging means for providing electric charges onto an image carrier to electrically charge the image carrier; light exposing means for exposing the charged image carrier to light to form an electrostatic latent image; developing means which retains a developing agent, supplies the developing agent to the electrostatic latent image to perform development, forms a developing agent image on the image carrier and collects the developing agent remaining on the image carrier; and transferring means which is configured to be pressed against the image carrier through a transfer medium and transfers the developing agent image onto the transfer medium to form a transferred image, wherein the developing agent contains a toner having an average particle diameter of 2 to 5 μm, the toner having a spherical degree of 1 to 1.2, and the transferring means is configured to be pressed against the image carrier by a pressing force having a total load of 150 g to 1500 g and a surface load of 10 to 150 g/cm$^2$ at the time of transfer.

Additional objects and advantages of the invention will be set forth in the description which follows, and in part will be obvious from the description, or may be learned by practice of the invention. The objects and advantages of the invention may be realized and obtained by the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
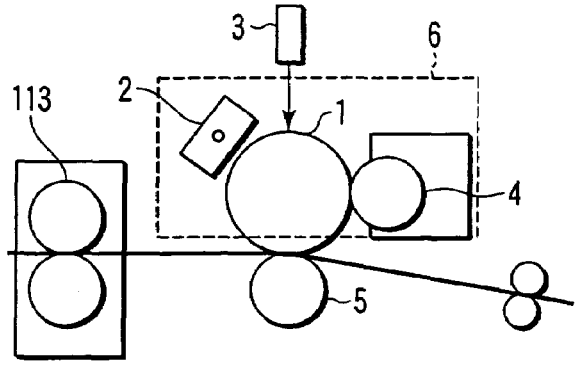
FIG. 1 is a schematic view showing an example of an image forming apparatus which is of an electrophotographic type according to the present invention.

According to the present invention, there is provided an image forming apparatus having an image forming unit comprising: charging means for providing electric charges to charge an image carrier; light exposing means for exposing the charged image carrier to light in order to form an electrostatic latent image; developing means for accommodating a developing agent therein and performing development by supplying the developing agent to the electrostatic latent image in order to form a developing agent image on the image carrier; and transferring means which can be pressed against the image carrier through a transfer medium and transfers the developing agent image onto the transfer medium to form a transfer image, the image forming apparatus being characterized in the developing agent to be used and a pressing force of the transferring means with respect to the image carrier at the time of transfer.

The developing agent to be used contains a toner having an average particle diameter of 2 to 5 μm and a spherical degree of 1 to 1.2, and the transferring means is pressed against the image carrier by a pressing force having a total load of 150 g to 1500 g and a surface load of 10 to 150 g/cm$^2$.

According to the present invention, by using the toner having an average particle diameter of 2 to 5 μm and a spherical degree of 1 to 1.2, the transfer efficiency becomes excellent and a toner quantity required to obtain a predetermine image density can be reduced. Furthermore, since the transferring means is pressed against the image carrier by a pressing force having a total load of 150 g to 1500 g and a surface load of 10 to 150 g/cm$^2$, filming can be avoided and an image memory can be prevented from being generated.

The plurality of image forming units can be used so that developing agents of different colors can be retaind in the respective image forming units. As a result, developing agent images having different colors can be sequentially transferred onto the transfer medium to form a multicolor transferred image.

When a toner particle diameter is less than 2 μm, the scatter of the toner from the developing device becomes terrible or the adhesion such as a van der Waals force with respect to the photoreceptor is increased, thereby deteriorating the transfer efficiency. When a toner particle diameter exceeds 5 μm, the fineness of an image is lost, and small characters or smooth halftone images are degraded.

When the spherical degree exceeds 1.2, a residual transfer toner quantity is increased, and an image defect is generated or a cleaning defect occurs. In particular, in the cleanerless process, a memory image becomes prominent.

Furthermore, when a total load is less than 150 g, the transfer efficiency is lowered. When a total load exceeds 1500 g, a damage given to the photoreceptor by the transfer member such as a belt in the transfer section becomes large, thereby shortening a life of the photoreceptor.

Moreover, when a surface load is less than 10 g/cm$^2$, the contact in the transfer nip section becomes uneven, which leads to the unevenness in images. When a surface load exceeds 150 g/cm$^2$, toner filming with respect to the photoreceptor becomes a problem.

An intermediate transfer body or a recording material can be used as the transfer medium.

When an intermediate transfer body is used as the transfer medium, final transferring means can be further provided on a rear stage of the plurality of image forming units. As a result, a multicolor transferred image can be transferred onto a recording material.

When a recording material is used as the transfer medium, developing agent images having different colors can be directly transferred onto the recording material to form a multicolor transferred image.

A mechanism which collects a developing agent remaining on the image carrier in the developing device after transferring a developing agent image can be further provided to the image forming unit.

Additionally, the developing means can further have means for collecting a residual developing agent simultaneously with development.

The image forming unit is a so-called cleanerless mechanism which is not provided with a cleaner which removes and discards a developing agent remaining on the image carrier after transfer of a toner image performed after transfer of a developing agent image.

The present invention will now be further concretely described hereinafter with reference to the accompanying drawings.

FIG. 1 is a schematic view showing an example of an image forming apparatus which is of an electrophotographic type using a cleanerless process according to the present invention.

In the drawing, an image carrier 1 is a photoreceptor drum having an organic or amorphous-silicon-based photosensitive layer provided on an electroconductive substrate. Here, an example in which an organic photoreceptor which is electrically charged to have a negative polarity is used as a photoreceptor drum will be explained. This image carrier 1 is evenly charged to, e.g., −500V by a charger 2, e.g., a known roller charger, a corona charger, a scorotron charger or the like. Thereafter, the image carrier 1 is subjected to an exposure 3 by light exposing means, e.g., an image-modulated laser beam or LED, and an electrostatic latent image is thereby formed on the surface of the image carrier 1. At this time, a potential on the surface of the exposed photoreceptor becomes, e.g., approximately −80V. Then, the electrostatic latent image is converted into a visible image by a developing device 4. A two-component developing agent in which a non-magnetic toner which is electrically charged to have a negative polarity and a magnetic carrier are mixed is retaind in the developing device. This non-magnetic toner has an average particle diameter of 2 to 5 μm and a spherical degree of 1 to 1.2. In this developing device 4, an ear using this carrier is formed on a developing roller provided with a magnet, and a developing bias voltage of approximately −200 to −400V is applied to the developing roller. By doing so, the toner which has adhered to the carrier further adheres to an exposed section on the photoreceptor surface, thereby forming a toner image. On the other hand, the toner does not adhere to a non-exposed section. It is to be noted that a voltage in which the AC bias of 1 to 10 kHz and 500 to 2000 Vp-p is superposed on the DC bias may be applied as the developing bias voltage.

A paper sheet is supplied between the photoreceptor 1 and a transfer member 5 such as a transfer roller by a non-illustrated paper supply/feed device, and a bias voltage of approximately +300 to 3 kV is applied to the transfer member 5. As a result, a toner image is transferred onto a paper sheet, thereby obtaining a transferred image. It is to be noted that this transfer member 5 is pressed against the image carrier at the time of transfer by a pressing force having a total load of 150 g to 1500 g and a surface load of 10 to 150 g/cm$^2$, and the transfer member 5 has a nip width of, e.g., 1 mm to 30 mm or, preferably, 0.3 cm. Further, a transfer blade, a transfer brush or the like can be used in place of the transfer roller. The residual toner remaining on the photoreceptor after transfer may have a (−) polarity or a (+) polarity depending on an environment or transfer bias conditions. Such a residual toner is subject to (−) electric charges and coordinated to have a (−) polarity when the photoreceptor is electrically charged to have a negative polarity in a charge process. Therefore, when the residual toner reaches a developing section, an image section is developed while adhering to the surface of the photoreceptor, the toner is collected to the developing roller side in a non-image section, and hence so-called development/simultaneous cleaning is carried out. As a result, a beautiful image can be obtained even if an image forming unit having a cleanerless mechanism which is not provided with a cleaning device such as a blade on the photoreceptor is used. On the other hand, the paper sheet having a transferred image formed thereon is introduced to a fuser 113, and the toner is fused on the paper sheet by heat and a pressure in the fuser, thereby obtaining a duplicated image.

In order to make the cleanerless mechanism practicable, realizing the high transfer efficiency is a point. When a quantity of the residual toner after transfer is large, there occurs a so-called positive memory by which the residual toner cannot be sufficiently removed in the developing section and image contamination is thereby generated. Furthermore, since the exposure is performed through the residual toner, a potential of the photoreceptor cannot be sufficiently reduced, and hence a negative memory having a pattern shape caused due to the residual toner occurs in a subsequent image forming process.

As described above, since an image memory such as a positive memory or a negative memory is generated when a residual toner quantity is large, the present inventors have tried an increase in transfer efficiency for a reduction in quantity of the residual toner, a reduction in quantity of the toner to be developed as much as possible and realization of a spherical shape of each toner particle for an increase in transfer efficiency.

First, a toner particle material was prepared with the following compositions.

| | |
|---|---|
| Polyester resin: | 90 parts by weight |
| Carbon black: | 5 parts by weight |
| Charge control agent (a zirconium complex of di-t-butylsaliclic acid): | 1 part by weight |
| Rice wax: | 4 parts by weight |

The above-described materials were mixed and melted, and an obtained mixture was dried, roughly ground and finely ground. The obtained ground product was classified to obtain toner particles having an average particle diameter of 3 μm.

2 parts by weight of silica as an addition agent were mixed to the surface of the obtained toner particles by using a Henschel mixer, thereby acquiring a toner.

Moreover, toner particles having each of average particle diameters of 4 μm, 5 μm, 6 μm and 7 μm were created in the same manner except that fine grinding and classification conditions are changed.

Additionally, the obtained toner particles are formed into a spherical shape.

A method of forming toner particles into a spherical shape can be considered as creation of the toner by a pulmerization method. However, in order to arbitrarily change the spherical degree, the polyester toner manufactured based on a regular grinding scheme was put in a surfusing system (manufactured by Nippon Pneumatic Mfg. Co., Ltd.), an air current maximum temperature was set to 350° C. whilst a dispersion concentration of the mixture in an air current was set to 200 g/cm$^2$, and a time required for an air current temperature to reach a glass transition temperature of the toner or a lower temperature was changed in a range of 0.4 to 2.0 seconds, thereby creating the toner with a various types of spherical degree.

It is to be noted that the spherical degree used here is a value obtained by multiplying SF1 calculated by the following method by 1/100.

Calculation of Sphericity Degree

In a projection figure in which the toner is projected in a two-dimensional plane, L is determined as a maximum value of a length of a straight line connecting two points on an outer periphery of the projection figure whilst S is determined as superficial content of the projection figure, and a shape factor SF1 defined by the following expression is calculated as follows.

$$SF1=(100\pi/4)\times(L2/S)$$

$$\text{Sphericity degree}=SF1/100$$

The obtained toner is applied to the image forming apparatus shown in FIG. 1 to perform image formation, and the transfer efficiency was measured.

Figure 2:
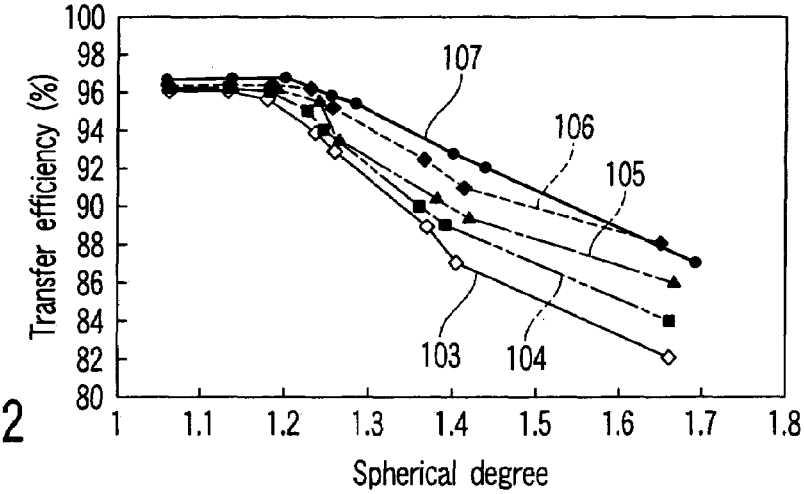
FIG. 2 is a graph showing a relationship between a spherical degree of a toner and transfer efficiency.

FIG. 2 shows a graph showing a relationship between the spherical degree of the toner and the transfer efficiency.

In the drawing, reference numeral 103 denotes a case using the toner having an average volume particle diameter of 3 μm; 104, a case using the toner having an average volume particle diameter of 4 μm; 105, a case using the toner having an average volume particle diameter of 5 μm; 106, a case using the toner having an average volume particle diameter of 6 μm; and 107, a case using the toner having an average volume particle diameter of 7 μm.

As shown in the drawing, when a toner particle diameter differs even though the spherical degree remains the same, the transfer efficiency changes. That is because a van der Waals force or an adhesion force caused due to condensed moisture in a force by which the toner adheres to the photoreceptor is increased when a toner particle diameter becomes small. Therefore, it can be considered that a small toner particle diameter is disadvantageous to an increase in transfer efficiency.

However, generation of a memory is affected by an absolute quantity of the residual toner rather than the transfer efficiency. There are two types of image memories as described above.

Figure 3A:
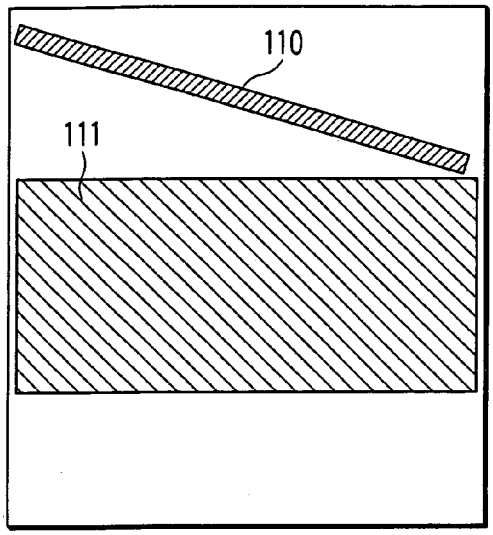
FIGS. 3A and 3B show examples of charts used for evaluation of an image memory.
Figure 3B:
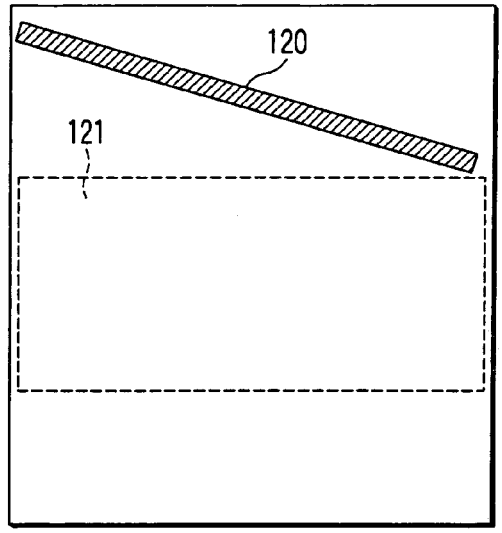
Figure 4A:
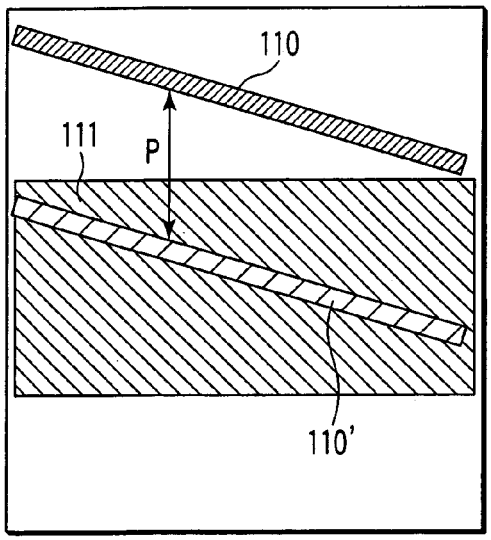
FIGS. 4A and 4B show examples of charts used for evaluation of an image memory.
Figure 4B:
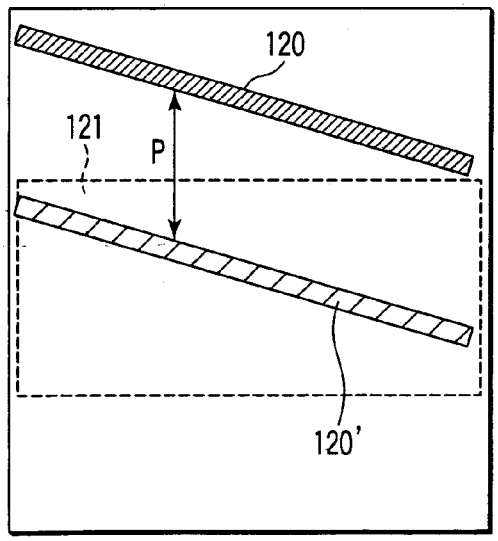

In the two types of image memories, a negative memory can be evaluated by using a chart shown in FIG. 3A and a positive memory can be evaluated by using a chart depicted in FIG. 3B, respectively, for example. FIGS. 4A and 4B are views illustrating the evaluation method.

FIG. 3A has a solid image 110 and a halftone image 111. When this chart is output by an image forming apparatus provided with a photoreceptor drum having a circumferential length P, an image memory appears in an area 110' shown in FIG. 4A if a negative memory is generated. Therefore, generation of the negative memory can be confirmed by measuring an image density Dn1 in the halftone image 111 and an image density Dn2 in the area 110' and obtaining a difference Dn between these image densities.

Further, FIG. 4B has the same solid image 120 as the solid image 110 depicted in FIG. 4A, and an area 121 is shown as a white space without forming a halftone image 111. When this chart is output by an image forming apparatus provided with a photoreceptor drum having a circumferential length P, an image memory appears in an area 120' depicted in FIG. 4B if a positive memory is generated. At this time, generation of the negative memory can be confirmed by measuring an image density Dp1 in the area 121 and an image density Dp2 in the area 120' and obtaining a difference Dp between these image densities.

When a residual toner quantity is increased, the negative memory concentration difference Dn and the positive memory concentration difference Dp are also increased.

Thus, the transfer bias was changed by using the toner having the same composition as that of the above-described developing agent, a residual toner quantity of a solid image was changed, and a duplicated image was formed by using the same image forming apparatus as that shown in FIG. 1. A residual toner quantity and an image density in each area were measured by using an image density meter RD-918 manufactured by Macbeth.

Figure 5:
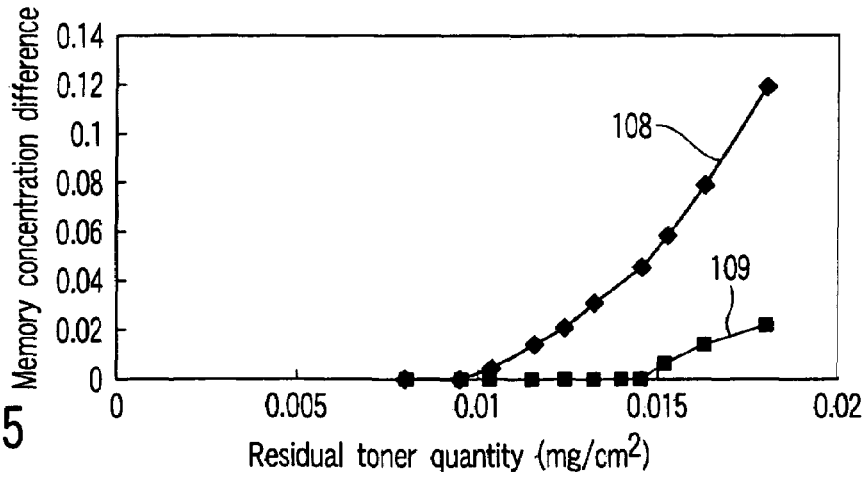
FIG. 5 is a view illustrating an evaluation method using the charts of FIGS. 3A and 3B.

FIG. 5 shows an obtained result.

FIG. 5 is a graph showing a relationship between a residual toner quantity, a negative memory concentration difference Dn and a positive memory concentration difference Dp.

In the drawing, reference numeral 108 denotes a curve representing a change in Dn and reference numeral 109 designates a curve representing a change in Dp.

In this example, a memory image can be visually confirmed and judged as an image defect when Dp becomes 0.02 or above and Dn becomes 0.04 or above.

It was revealed from the graph of FIG. 5 that calculating a residual toner quantity which realizes Dp<0.02 and Dn<0.04 can obtain an excellent image without a memory image defect in case of 0.014 mg/cm$^2$ or below.

Figure 6:
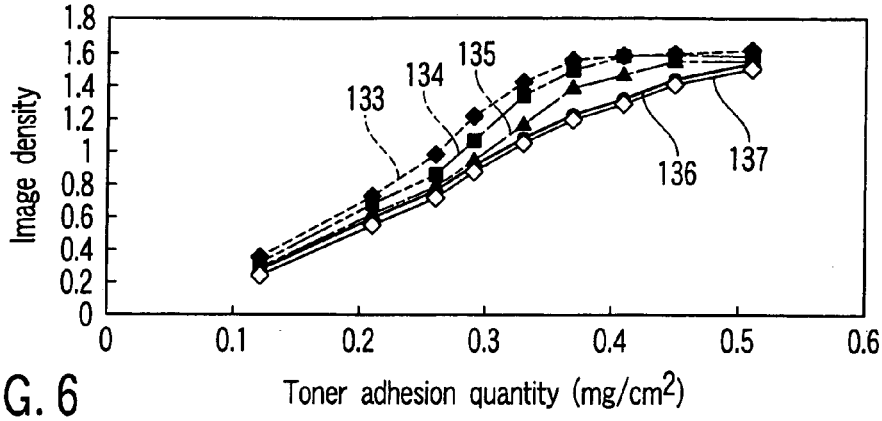
FIG. 6 is a view illustrating an evaluation method using the charts of FIGS. 4A and 4B.

Then, a particle diameter of the developing agent was changed, a duplicated image of the solid image was formed, and a quantity of a toner which has adhered to a paper sheet and an image density at this moment were measured. FIG. 6 shows its result.

It is to be noted that the quantity of an adhered toner on the paper sheet is obtained by sucking the toner in a fixed area to remove the toner therefrom and then calculating the quantity in accordance with Mr/25 (mg/cm$^2$) wherein Mr (mg) is a weight difference of the paper sheet before and after the above removal.

FIG. 6 is a graph showing a relationship between a quantity of the toner which has adhered to the paper sheet and an image density with respect to the toner having various average particle diameters.

In the drawing, reference numeral 133 denotes a result concerning the toner having an average particle diameter of 3 μm; 134, a result concerning the toner having an average particle diameter of 4 μm; 135, a result concerning the toner having an average particle diameter of 5 μm; 136, a result concerning the toner having an average particle diameter of 6 μm; and 137, a result concerning the toner having an average particle diameter of 7 μm.

Figure 7:
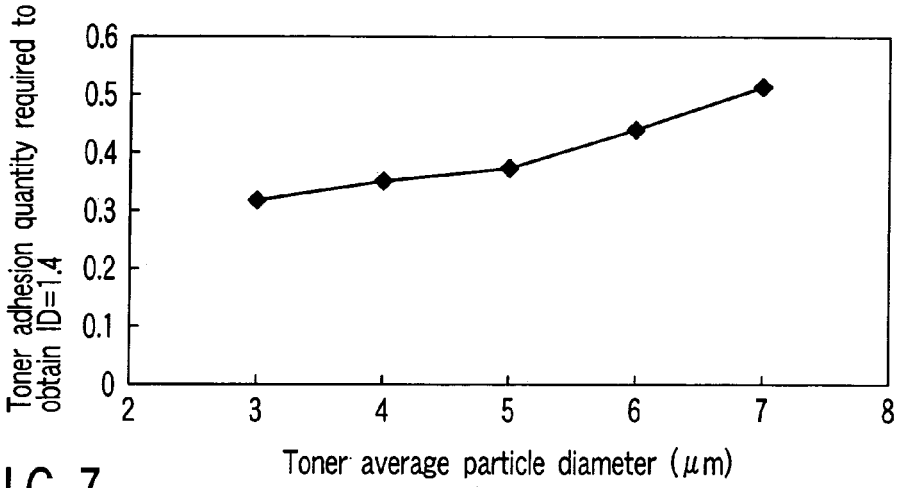
FIG. 7 is a graph showing a relationship between a toner particle diameter and a toner adhesion quantity required to obtain a sufficient image density.

An image density of 1.4 is required for a solid image. FIG. 7 is a graph showing a relationship between a toner particle diameter and a toner adhesion quantity required to obtain a concentration of 1.4.

Of the toner adhesion quantity required to obtain the concentration of 1.4 depicted in FIG. 7, a ratio at which the post-transfer residual toner is obtained is 100 (%)−the transfer efficiency (%) shown in FIG. 2.

Each post-transfer residual toner quantity was calculated based on a ratio providing the post-transfer residual toner obtained from FIG. 2 and a required toner adhesion quantity corresponding to each toner particle diameter. The following Table 1 shows obtained results.

TABLE 1

| Particle diameter | Sphericity degree | Residual transfer toner quantity |
|---|---|---|
| 3 μm | 1.668892 | 0.05688 |
| | 1.401345 | 0.04108 |
| | 1.36612 | 0.03476 |
| | 1.256913 | 0.02212 |
| | 1.231906 | 0.01896 |
| | 1.178898 | 0.013904 |
| | 1.129178 | 0.01264 |
| | 1.062191 | 0.01264 |
| 4 μm | 1.66113 | 0.056 |
| | 1.388889 | 0.0385 |
| | 1.358696 | 0.035 |
| | 1.244942 | 0.021 |
| | 1.22549 | 0.0175 |
| | 1.182536 | 0.014 |
| | 1.132631 | 0.0133 |
| | 1.058985 | 0.01295 |
| 5 μm | 1.668892 | 0.0518 |
| | 1.418842 | 0.03885 |
| | 1.379691 | 0.03515 |
| | 1.265022 | 0.02405 |
| | 1.241003 | 0.01665 |
| | 1.192969 | 0.01332 |
| | 1.136105 | 0.01369 |
| | 1.064339 | 0.01295 |
| 6 μm | 1.651528 | 0.05244 |
| | 1.412429 | 0.03933 |
| | 1.364629 | 0.032775 |
| | 1.250899 | 0.020976 |
| | 1.229332 | 0.016606 |
| | 1.184059 | 0.015295 |
| | 1.130902 | 0.015295 |
| | 1.058453 | 0.015295 |
| 7 μm | 1.692861 | 0.0663 |
| | 1.437998 | 0.0408 |
| | 1.397198 | 0.03672 |
| | 1.282243 | 0.02346 |
| | 1.25372 | 0.02142 |
| | 1.200733 | 0.01683 |
| | 1.137094 | 0.01683 |
| | 1.056757 | 0.01683 |

Figure 8:
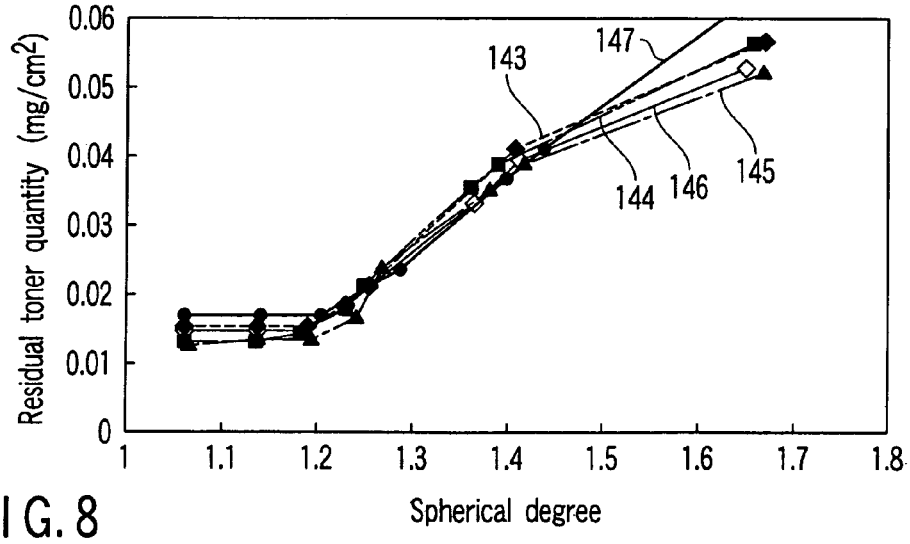
FIG. 8 is a graph showing a relationship between a spherical degree and a residual toner quantity when a toner particle diameter is changed.

Furthermore, FIG. 8 is a graph showing a relationship between the spherical degree and a residual toner quantity when toner particle diameters obtained from results of Table 1 are changed.

In the drawing, reference numeral 143 denotes a result concerning the toner having an average particle diameter of 3 μm; 144, a result concerning the toner having an average particle diameter of 4 μm; 145, a result concerning the toner having an average particle diameter of 5 μm; 146, a result concerning the toner having an average particle diameter of 6 μm; and 147, a result concerning the toner having an average particle diameter of 7 μm.

A residual toner quantity when a toner particle diameter and a toner spherical degree are adjusted can be derived from FIG. 8. It can be understood from FIG. 8 that using the toner having a toner particle diameter of 5 μm or below and a spherical degree of 1.2 or below can suffice to realize a residual toner quantity of 0.014 mg/cm$^2$ in order to prevent a memory image from becoming a problem.

It was revealed that a toner quantity required to obtain an image with a predetermined concentration can be reduced when a particle diameter of the toner is decreased in this manner.

A method of measuring the transfer efficiency and a residual toner quantity will now be described.

Figure 9:
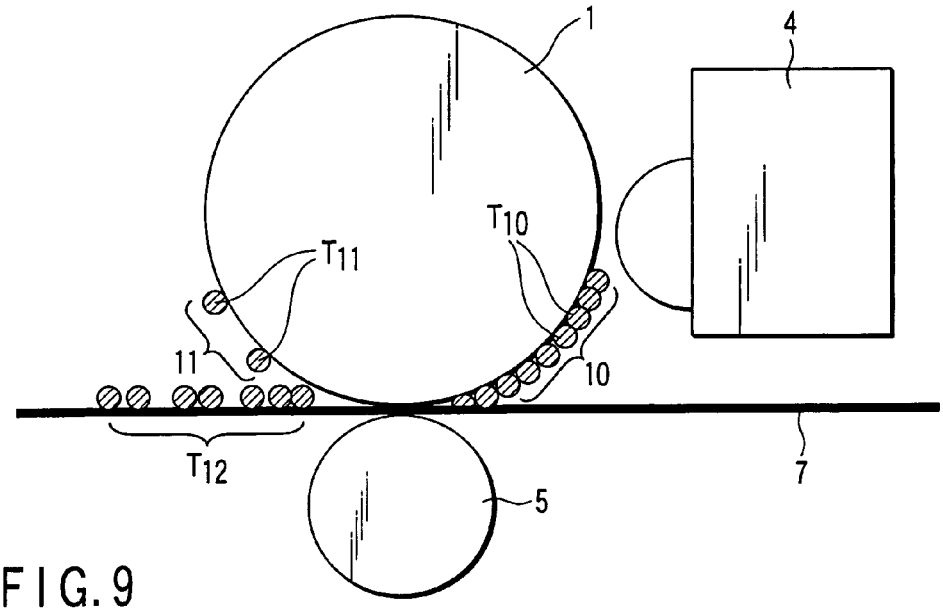
FIG. 9 is a view illustrating a method of measuring transfer efficiency and a residual toner quantity.

FIG. 9 is a view illustrating a method of measuring the transfer efficiency and a residual toner quantity.

In the drawing, reference numeral 1 denotes an image carrier; 4, a developing device; and 5, a transfer member.

As shown in the drawing, a toner T10 developed by the developing device 4 passes through a transfer area between the image carrier 1 and the transfer member 5, and is divided into transfer a toner T12 transferred onto a transfer medium 7, e.g., a paper sheet and a residual toner T11 which remains on the photoreceptor without being transferred. Here, a relationship of a developed toner quantity=a transferred toner quantity+a residual toner quantity can be attained.

Measurement of Developed Toner Quantity (Md)

The toner in an area 10 is sucked by an amount corresponding to an area of 1 cm×10 cm, and a photoreceptor weight before suction Md1 and a photoreceptor weight after suction Md2 are measured, thereby performing a calculation based on Md=(Md1−Md2)/10. Likewise, the toner in an area 11 is sucked by an amount corresponding to an area 1 cm×10 cm, and a photoreceptor weight before suction Mr1 and a photoreceptor weight after suction Mr2 are measured, thereby performing a calculation based on Mr=(Mr1−Mr2)/10.

The transfer efficiency can be calculated based on the following expression.

$$\text{Transfer efficiency}=(Md-Mr)/Md\times 100(\%)$$

It is to be noted that a residual toner quantity is Mr (mg/cm$^2$).

Figure 10:
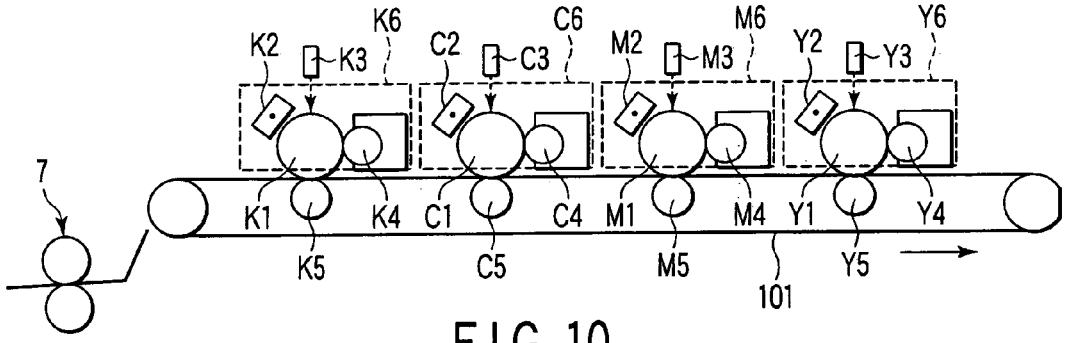
FIG. 10 is a schematic view showing an example of a color image forming apparatus according to the present invention.

FIG. 10 shows an example in which such an image forming unit having a cleanerless mechanism as shown in FIG. 1 is adopted in a four-drum tandem image forming apparatus.

In the drawing, the same reference numerals denote the same members, and Y, M, C and K means that their members are used for a yellow image, a magenta image, cyan image and a black image, respectively.

A plurality of image forming units Y6, M6, C6 and K6 which are so-called tandem type devices are arranged on a carriage member 101 such as a belt. First, in the image forming unit Y6 on a first stage, an image carrier Y1 is a photoreceptor drum having an organic or amorphous-silicon-based photosensitive layer provided on an electroconductive substrate. Here, a description will be given as to an example of an organic photoreceptor which is electrically charged to have a negative polarity. This image carrier Y1 is evenly charged to, e.g., −500V by a charger Y2, e.g., a roller charger, a corona charger, a scorotron charger or the like. Thereafter, the image carrier 1Y is subjected to an exposure 3Y by light exposing means, e.g., an image-modulated laser beam or LED, and an electrostatic latent image is thereby formed on the surface. At this time, a potential on the surface of the exposed photoreceptor becomes, e.g., approximately −80V. Then, the electrostatic latent image is converted into a visible image by a developing device 4Y. A two-component yellow developing agent in which a non-magnetic yellow toner which is charged to have a negative polarity is mixed with a magnetic carrier is retaind in the developing device Y4. This non-magnetic toner has an average particle diameter of 2 to 5 μm and a spherical degree of 1 to 1.2. In this developing device Y4, an ear using the carrier is formed on a developing roller provided with a magnet, and a voltage of approximately −200 to −400V is applied to the surface of the developing roller. By doing so, the toner which has adhered to the carrier further adheres to an exposed section on the surface of the photoreceptor Y1 to form a yellow toner image, but the toner does not adhere to a non-exposed section.

Moreover, the yellow toner image on the photoreceptor is transferred onto a non-illustrated transfer medium such as a paper sheet carried by the belt-like carriage member 101 which is in contact with the photoreceptor Y1, thereby forming a yellow transferred image.

Supply of an electric field at this moment is carried out by transferring means Y5 such as a transfer roller which is in contact with a rear surface of the transfer belt. As the transferring means Y5, a transfer blade, a transfer brush or the like can be also used. A voltage applied to the transferring means Y5 is approximately +300 to 3 kV. It is to be noted that this transferring means Y5 is pressed against the image carrier with a pressing force having a total load of 150 g to 1500 g and a surface load of 10 to 150 g/cm$^2$.

The residual toner or the like remaining on the photoreceptor after transfer is transmitted to a non-illustrated disturbance member which is used to remove a memory of a post-transfer residual image, the photoreceptor is appropriately subjected to discharge processing, and then the above-described charge process is again repeated. At this time, since the residual toner which has passed through the charge section has been subjected to the charge process, it has been charged to have the same polarity as a charge potential of the photoreceptor, e.g., a negative polarity. When this residual toner reaches a developing section, an image section is developed while adhering to the surface of the photoreceptor in the developing section, and the developing roller is collected to the developing roller side and so-called development/simultaneous cleaning is carried out in a non-image section. As a result, the image forming process of the image forming section Y6 on the first stage is continuously performed even if a cleaning device such as a blade is not provided on the photoreceptor.

Subsequently, an image forming unit M6 on a second and subsequent stages has the same configuration as that of the first stage except that a two-component magenta developing agent in which a non-magnetic magenta toner which is electrically charged to have a negative polarity is mixed with a magnetic carrier is retaind in a developing device M4.

In a transfer section, the yellow transferred image transferred onto the transfer medium in the image forming unit Y6 on the preceding stage is carried by paper carrying means, and enters the transfer section between the photoreceptor M1 on the second stage and the transferring means M5.

In the present invention, since the toner having an average particle diameter of 2 to 5 μm and the spherical degree of 1 to 1.2 is used and the transfer member which is pressed against the image carrier by a pressing force having a total load of 150 g to 1500 g and a surface load of 10 to 150 g/cm$^2$ at the transfer is used, a part of an image formed in the image forming section on the first stage is hardly reverse-transferred onto the image carrier on the second stage. Additionally, an excessive discharge phenomenon rarely occurs in the transfer section, and hence a mixed color phenomenon is hardly occurred.

In the transfer section on the second stage, a magenta transferred image is formed on the transfer medium having the yellow transferred image formed thereon.

An image forming unit C6 and an image forming unit K6 having the same configuration are arranged on the rear stage of this image forming unit M6, and a cyan transferred image and a black transferred image are sequentially formed on this transfer medium, thereby obtaining a multicolor transferred image.

Further, the multicolor image can be fused on the transfer medium by hot pressing using fusing means 7 provided on the rear stage of the image forming unit K6, thereby acquiring a multicolor duplicated image.

A high-quality image having no memory can be also obtained in the image forming apparatus having the cleanerless mechanism by using the tandem type image forming apparatus like the monochromatic image forming apparatus.

As different from the monochromatic image forming apparatus, since colors are superposed in the color image forming apparatus, the toner must be readily fused. However, when a binder resin, a molecular quantity, a wax addition quantity and others of the color toner are appropriately composed so that a softening point of the color toner is adjusted to be lower than that of a monochromatic toner, there occurs a problem that filming is apt to be generated. However, when the softening point is set high, generation of filming can be avoided but, on the other hand, the fixing properties are deteriorated.

Thus, the present inventors have examined about load conditions and occurrence of filming in the transfer section.

Figure 11:
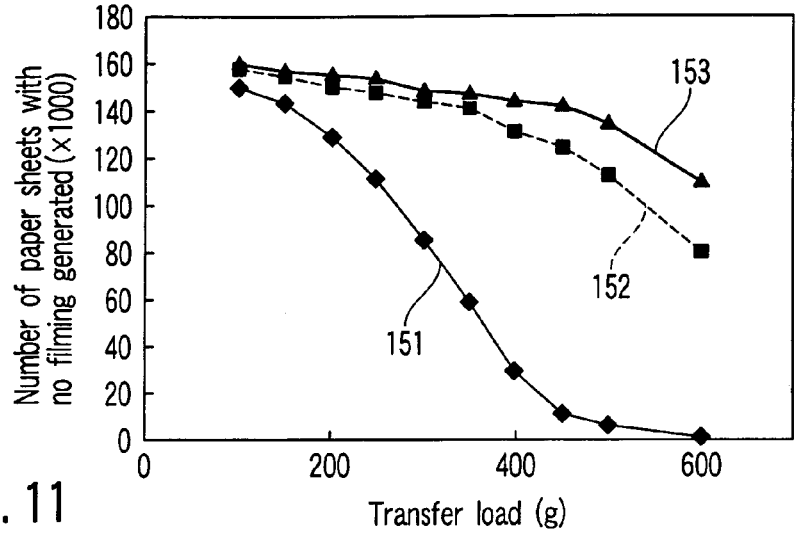
FIG. 11 is a graph showing a relationship between a transfer load and the number of paper sheets printed until filming is generated in various transfer nip widths.

FIG. 11 is a graph showing a relationship between a transfer load and the number of paper sheets printed until filming occurs in various transfer nip widths.

In the drawing, reference numeral 151 denotes a case when a nip width is 0.06 cm; 152, a case in which a nip width is 0.12 cm; and 153, a case when a nip width is 0.18 cm.

Here, a transfer roller having a diameter of 18 mm and a width of 300 mm was used as a transfer member. Furthermore, a transfer load is determined as a total weight applied to this transfer roller.

Occurrence of filming is determined as a point in time where generation of a stripe-like noise image is visually confirmed. The transfer load and the filming have a correlation, and it can be considered that the filming is produced when a pressure is applied to the toner in the transfer section.

As apparent from FIG. 11, it can be understood that the filming is hardly generated when the nip width is large even though the same transfer load is used.

Figure 12:
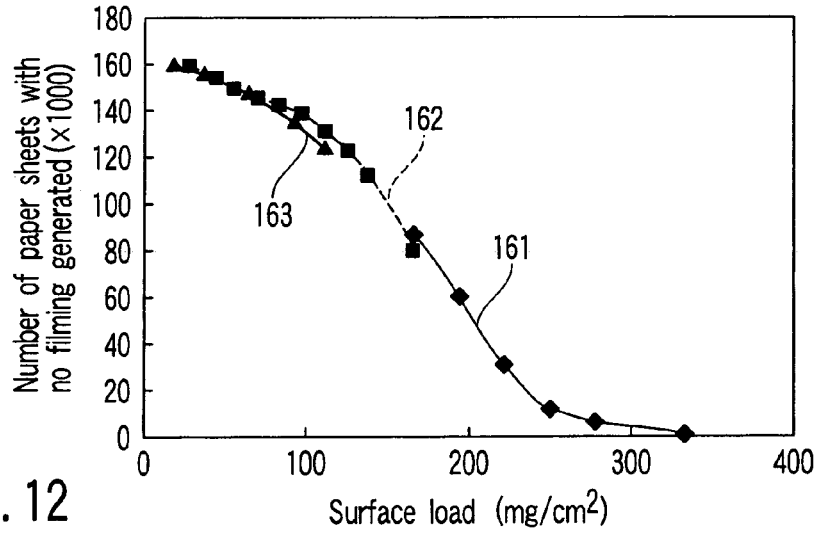
FIG. 12 is a graph in which a horizontal axis of the graph of FIG. 11 is converted to a surface load.

FIG. 12 is a graph in which a horizontal axis of the graph depicted in FIG. 11 is converted to a surface load.

In the drawing, a reference numeral 161 denotes a case in which a nip width is 0.06 cm; 162, a case in which a nip width is 0.12 cm; and 163, a case in which a nip width is 0.18 cm.

In this example, the surface load means a transfer load per unit area of 1 $cm^2$, and can be represented by the following expression.

$$\text{Surface load}(g/cm^2)=\text{transfer load}(g)/(\text{transfer roller width}(cm)\times\text{nip width}(cm))$$

The surface load can be adjusted by using the transfer load and the nip width.

As shown in the drawing, it can be understood that the surface load and the number of paper sheets printed until filming occurs are deeply linked with each other. On the other hand, however, there is a fear that the transfer efficiency may be lowered as the transfer load is decreased.

Figure 13:
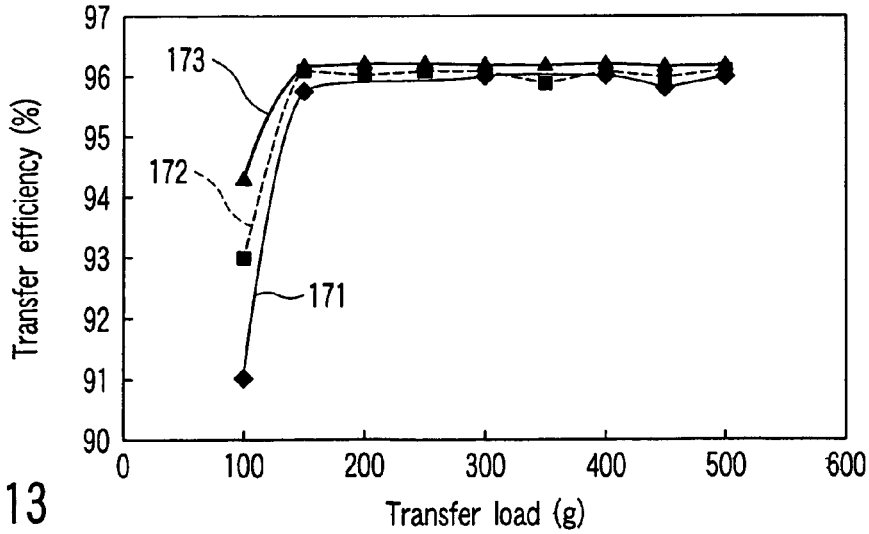
FIG. 13 is a graph showing a relationship between a transfer load and transfer efficiency.

FIG. 13 shows a result of measuring the transfer efficiency while changing the transfer load conditions.

In the drawing, reference numeral 171 denotes a case when a nip width is 0.06 cm; 172, a case in when a nip width is 0.12 cm; and 173, a case in when a nip width of 0.18 cm.

As shown in the drawing, in regard to the transfer efficiency, since the transfer efficiency is less changed even if the nip width is varied, it was understood that the transfer efficiency has a correlation with the total load rather than the surface load and the transfer efficiency is deteriorated with a load which is not greater than 150 g.

That is, beautiful printing which does not produce filming and a transfer memory can be effected by adjusting the transfer load so that the total load exceeds 150 g and the surface load becomes 150 $g/cm^2$ or below.

In the image forming apparatus shown in FIGS. 1 and 10, the transfer belt is the paper carrying means and a transferred image is directly formed on the transfer medium. However, an intermediate transfer body can be used as the transfer belt, a transferred image can be once formed on the intermediate transfer body, and then a final image can be formed on the recording material by using final transferring means.

Figure 14:
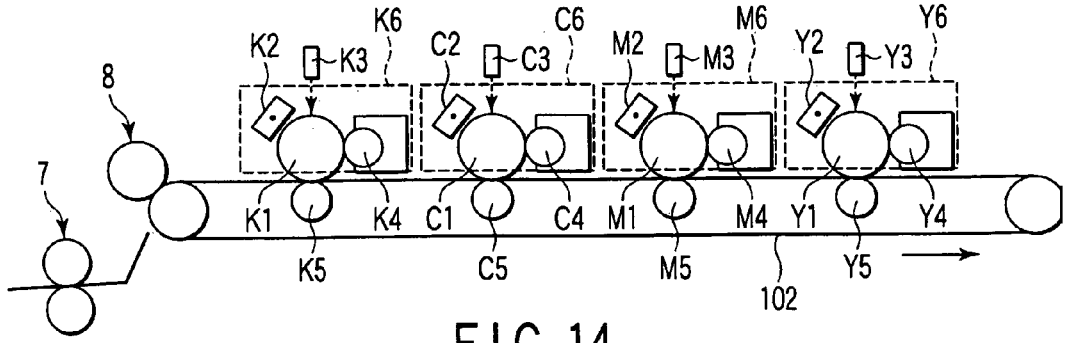
FIG. 14 shows a modification of the image forming apparatus depicted in FIG. 14.

FIG. 14 shows a modification of the image forming apparatus depicted in FIG. 10.

As shown in the drawing, this image forming apparatus has the same configuration as that of FIG. 10 except that an intermediate transfer belt 102 is provided in place of the carriage belt 101 and final transferring means 8 is further provided between an image forming unit K6 and fixing means 7. In this apparatus, a yellow transferred image, a magenta transferred image, a cyan transferred image and a black transferred image are sequentially formed on the intermediate transfer belt in the respective image forming units Y6, M6, C6 and K6, and the thus obtained multicolor image is transferred onto a non-illustrated recording material such as a paper sheet in the final transferring means 8. Thereafter, the multicolor transferred image is subjected to hot pressing and fused, thereby obtaining a multicolor duplicated image.

In the apparatus depicted in FIG. 14, beautiful printing which does not produce filming and a transfer memory can be effected by using the toner having an average particle diameter of 2 to 5 μm and a spherical degree of 1 to 1.2 and adjusting the load conditions of the transfer section from the image carrier to the intermediate transfer belt so that its total load exceeds 150 g and its surface load becomes 150 $g/cm^2$ or below.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image forming apparatus having an image forming unit comprising: charging means for providing electric charges onto an image carrier to electrically charge the image carrier; light exposing means for exposing the charged image carrier to light to form an electrostatic latent image; developing means which retains a developing agent, supplies the developing agent to the electrostatic latent image to perform development, forms a developing agent image on the image carrier and collects the developing agent remaining on the image carrier; and transferring means which is configured to be pressed against the image carrier through a transfer medium and transfers the developing agent image onto the transfer medium to form a transferred image, wherein the image forming unit is a cleanerless mechanism which does not include a cleaner which removes and discards a residual developing agent remaining on the image carrier after transfer of the developing agent image, a quantity of the residual developing agent is 0.014 mg/cm$^2$ or below, the developing agent contains a toner having an average particle diameter of 2 to 5 μm, the toner having a spherical degree of 1 to 1.2, and the transferring means is configured to be pressed against the image carrier by a pressing force having a total load of 150g to 1500 g and a surface load of 10 to 150 g/cm$^2$ at the time of transfer.

2. The image forming apparatus according to claim 1, comprising the plurality of image forming units, wherein developing agents of different colors are retained in the respective image forming units, and developing agent images of different colors are sequentially transferred onto the transfer medium, thereby forming a multicolor transferred image.

3. The image forming apparatus according to claim 2, wherein the transfer medium is an intermediate transfer body, and final transferring means for transferring the multicolor transferred image onto a recording material is further provided on a rear stage of the plurality of image forming units.

4. The image forming apparatus according to claim 2, wherein the transfer medium is a recording material, and developing agent images of different colors are directly transferred onto the recording material to form a multicolor transferred image.

5. The image forming apparatus according to claim 1, wherein the toner has-a spherical degree of 1.1 to 1.2.

6. An image forming apparatus having an image forming unit comprising: a charger which provides electric charges to an image carrier; an exposure section which exposes the charged image carrier to light to form an electrostatic latent image;

a developing device which retains a developing agent, supplies the developing agent to the electrostatic latent image to perform development, forms a developing agent image on the image carrier and collects the developing agent remaining on the image carrier; and a transfer member which is configured to be pressed against the image carrier through a transfer medium and transfers the developing agent image onto the transfer medium to form a transferred image, wherein the image forming unit is a cleanerless mechanism which does not include a cleaner which removes and discards a residual developing agent remaining on the image carrier after transfer of the developing agent image, a quantity of the residual developing agent is 0.014 mg/cm$^2$ or below.

the developing agent contains a toner having an average particles size of 2 to 5 μm, the toner having a spherical degree of 1 to 1.2, and the transfer member is configured to be pressed against the image carrier by a pressing force having a total load of 150 g to 1500 g and a surface load of 10 to 150 g/cm$^2$ at the time of transfer.

7. The image forming apparatus according to claim 6, having the plurality of image forming units, wherein developing agents of different colors are retained in the respective image forming units, and developing agent images of different colors are sequentially transferred onto the transfer medium, thereby forming a multicolor transferred image.

8. The image forming apparatus according to claim 7, wherein the transfer medium is an intermediate transfer body, and a final transfer member which transfers the multicolor transferred image onto a recording material is further provided on a rear stage of the plurality of image forming units.

9. The image forming apparatus according to claim 7, wherein the transfer medium is a recording material, and developing agent images of different colors are directly transferred onto the recording material to form a multicolor transferred image.

10. The image forming apparatus according to claim 6, wherein the toner has-a spherical degree of 1.1 to 1.2.

11. An image forming method including an image forming process comprising: a charge step which electrically charges an image carrier by providing electric charges thereto; a light exposure step which exposes the charged image carrier to light to form an electrostatic latent image; a development step which retains a developing agent, supplies a developing agent to the electrostatic latent image to perform development, forms a developing agent image on the image carrier and collects the developing agent remaining on the image carrier; and a transfer step which is configured to be pressed again the image carrier through a transfer medium and transfers the developing agent image onto the transfer medium to form a transferred image, wherein the image forming unit is a cleanerless mechanism which does not include a cleaner which removes and discards a residual developing agent remaining on the image carrier after transfer of the developing agent image, a quantity of the residual developing agent is 0.014 mg/cm$^2$ or below, the developing agent contains a toner having an average particle diameter of 2 to 5 μm, the toner having a spherical degree of 1 to 1.2, and the transferring means is configured to be pressed against image carrier by a pressing force having a total load of 150 g to 1500 g and a surface load of 10 to 150 g/cm$^2$ at the time of transfer.

12. The image forming method according to claim 11, comprising the plurality of image forming processes, wherein developing agents of different colors are retained in the respective image forming processes, and developing agent images of different colors are sequentially transferred onto the transfer medium, thereby forming a multicolor transferred image.

13. The image forming method according to claim 12, wherein the transfer medium is an intermediate transfer body, and a final transfer step which transfers the multicolor transferred image onto the recording material is further provided on a rear stage of the plurality of image forming processes.

14. The image forming method according to claim 12, wherein the transfer medium is a recording material, and developing agents of different colors are directly transferred onto the recording material, thereby forming a multicolor transferred image.

15. The image forming method according to claim 11, wherein the toner is made spherical by a thermal process that comprises:

grinding the toner;

dispersing the ground toner into an air stream having a maximum temperature of 350° C., so as to heat the ground toner to cause the ground toner to melt.

16. The image forming method according to claim 11, wherein the toner has-a spherical degree of 1.1 to 1.2.

* * * * *